United States Patent [19]

Poulin

[11] 4,195,837

[45] Apr. 1, 1980

[54] GOLF CLUB GRIP

[75] Inventor: Raymond J. Poulin, Topanga, Calif.

[73] Assignee: Tacki-Mac Grips, Inc., Canoga Park, Calif.

[21] Appl. No.: 933,104

[22] Filed: Aug. 11, 1978

[51] Int. Cl.[2] ..... A63B 53/14

[52] U.S. Cl. ..... 273/81 R; 273/810; 273/815; 40/317

[58] Field of Search ..... 273/75, 76, 77 R, 77 A, 273/81 R, 81 A, 81 B, 81 C, 81 D, 81.2, 81.3, 81.4, 81.5, 81.6, 162 R, 162 D; 40/317

[56] References Cited

U.S. PATENT DOCUMENTS

| | | | |
|---|---|---|---|
| 430,774 | 6/1890 | Hamilton | 273/162 R |
| 1,942,122 | 1/1934 | Reach | 273/162 D |
| 2,704,211 | 3/1955 | Decepoli | 273/81 A |
| 3,366,384 | 1/1968 | Lamkin et al. | 273/81 R |
| 3,606,325 | 9/1971 | Lamkin et al. | 273/81.5 X |

FOREIGN PATENT DOCUMENTS

| | | | |
|---|---|---|---|
| 1194124 | 6/1970 | United Kingdom | 273/81 R |

*Primary Examiner*—Charles E. Phillips
*Attorney, Agent, or Firm*—Fulwider, Patton, Rieber, Lee & Utecht

[57] ABSTRACT

A golf club grip has an end cap retained in place by a bond with the plastic grip. The cap has a central recess which receives a transparent closure, beneath which is a desired display. The cap is composed of molded plastic and has circumferential shoulders enabling withdrawal of the mold parts and forming recessed seats for the transparent closure, at the outside of the cap, and the plastic grip material, at the inside of the cap.

2 Claims, 3 Drawing Figures

GOLF CLUB GRIP

BACKGROUND OF THE INVENTION

1. Field of the Invention

The present invention relates to handles or grips for ball game playing devices, such as golf clubs, racquets or the like, and more particularly to the application of an end cap to the grip or handle section of clubs, racquets or the like.

2. The Prior Art

In the production of devices for the playing of ball games, such as golf, tennis or other games where a hand grip is applied to the end of the hand grip section of the shaft of the club or racquet, it has been the practice to apply wrapped grips of leather, plastic or composition materials, wrapped in a spiral from the extremity of the handle a suitable distance towards the head.

Later, molded plastic sleeves have been developed, which are applicable to the hand grip section and which can be cemented or secured in place on the shaft by a solvent for the plastic material. Such assembly of the resilient grip on the shaft poses problems in terms of venting the solvent or cementing material to the atmosphere at the extremity of the shaft.

SUMMARY OF THE INVENTION

The present invention relates to an improved ball playing device, golf club, racquet or the like, having a plastic resilient grip which is molded in generally tubular or long tapered hollow form for application, endwise, over the end of the shaft of the club or racquet and whereby the end or extremity of the grip is finished with a cap which is secured to the grip and enables the application of desired visible indicia, such as monograms, trademarks, ornamental matter or identifying legends.

More specifically, the invention involves a golf club, racquet or the like, to which a resilient grip is applied over the shaft and to which an end cap is applied, the end cap providing means for displaying selected indicia through a transparent center member of the cap.

In accomplishing the foregoing, an elongated, plastic and resilient grip member or sleeve is applied over the end of the grip section of the shaft, the sleeve having an open outer end enabling evaporation or drying of cement or solvent which secures the sleeve in place on the shaft and wherein a smooth, plastic end cap is secured on the extreme end of the grip, as by heat and pressure, the cap having an opening defined by a circular wall which provides retaining means for a complemental, transparent disc, the disc being applicable to the cap in overlying relation to a suitable selected insert bearing indicia, such as a monogram, trademark or identifying information, or the like. Alternatively, the indicia may be applied to the disc, either internally or externally.

The end cap, in accordance with the invention, is formed of molded plastic and provides an external, circular seat for the display disc, the seat being circumscribed by an overhanging annular shoulder for retaining the disc in the seat.

In addition, the inner side of the cap has a circular cavity for receiving the end of the plastic grip material in bonded relation, the cavity being circumscribed by an overhanging annular shoulder which forms a mechanical connection with the plastic material of the grip. The oppositely facing shoulders of the recess and the cavity, also, facilitate production by molding procedures, and a split mold can be separated by pulling one mold part from the recess for the center disc, with the cap retained on the mold part which forms the shoulder in the cavity for the grip. The latter mold part can then be easily pulled from the cap when the outer periphery of the cap is unrestrained against resilient expansion.

OBJECTS OF THE INVENTION

An object of the invention is to provide an improved grip structure for ball game playing devices, such as golf clubs, racquets and the like, which is easy to assemble with the shaft and forms an attractive, smooth end piece or cap.

Another object is to provide such a grip structure which facilitates the display of selected indicia.

BRIEF DESCRIPTION OF THE DRAWINGS

Referring to the drawings.

DESCRIPTION OF THE PREFERRED EMBODIMENT

Figure 1:
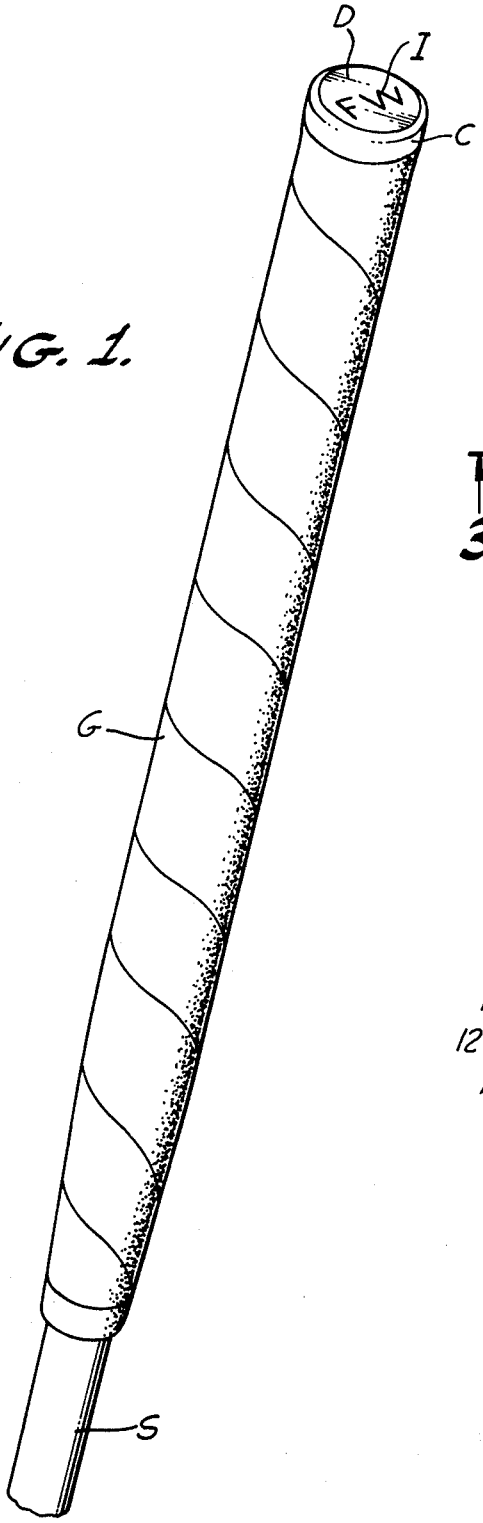
FIG. 1 is a perspective view showing a golf club grip having an end cap in accordance with the invention.
Figure 2:
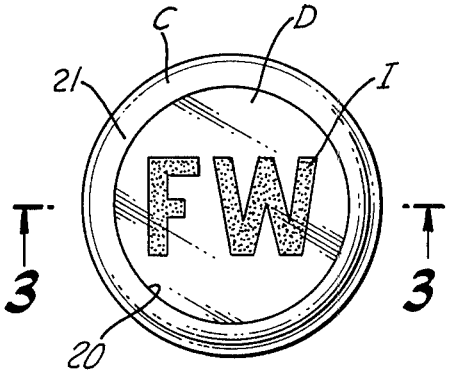
FIG. 2 is an enlarged end elevation of the club of FIG. 1.

As seen in FIG. 1, a ball game device is shown in the form of a golf club grip, the head being broken away for simplicity, wherein the club shaft S has a molded plastic grip G applied thereto, and, at the extremity of the grip is a cap C, in accordance with the invention, displaying selected indicia I which may be personal initials, monogram, manufacturer's trademark, club identification, or the like. As is known, the grip G is a tubular section of molded plastic material, for example polypropelene. The cap C is also, preferably, composed of a molded plastic material capable of being united with the grip material under heat and pressure.

Figure 3:
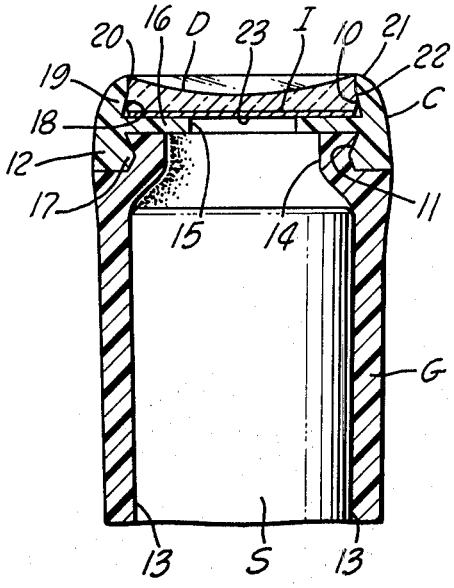
FIG. 3 is a fragmentary longitudinal section, as taken on the line 3—3 of FIG. 2.

The indicia I is seen in a central circular region or disc D in the cap, the disc, as seen in FIG. 3, being secured within a circular seat 10 in the cap, and the cap having a circular cavity 11 defined within an annular flange 12 in which the grip material is secured to retain the cap on the grip.

The shaft S is seen, in FIG. 3, as being covered by the grip G and bonded thereto by a layer or film 13, provided by a cement or by a solvent applied at the interface of the shaft with the grip. The evaporation or drying of the cement or bond is facilitated by the outer extremity of the grip having an opening 14, shown for simplicity as a central opening, which, as later described, provides a vent to the atmosphere, and the cap also has a central opening 15 which, before application of the disc D opens to the atmosphere, so that the cap can be applied before the solvent or cement has set or vaporized.

The cap C has an internal flange 16, having the opening 15 therein, and extending inwardly from the flange 12 to form with the flange 12 the lower cavity 11 which receives the grip material. The flange 12 also has as an inwardly extended shoulder or flange 17 opposing the flange 16 to form the cavity 11, into which cavity the plastic grip material can extend when the cap is applied to the grip, under heat and pressure, to effect a mechanical connection between the cap and the grip.

The seat 10 for the disc D is defined between the upper surface of the flange 16 and an upwardly and inwardly inclined or bevelled wall 18 of an annular, outer rim 19 of the cap. This bevelled wall 18 merges with a cylindrical wall 20 of the rim 19 which opens at the outer edge of the rim.

The disc D has an outer peripheral form corresponding with the internal form of the rim 19, that is, an outer cylindrical portion 21 and an inwardly extended bevelled section 22, adapted to be pressed into the seat 10, by axial pressure which can resiliently and outwardly expand the rim 19.

Indicia I, as previously described, is to be displayed by the disc D. Such indicia can be applied to the inner surface of the disc D by a coating 23, or the indicia can be provided on a separate disc. In either case, the indicia can be selected as desired, and viewed through the transparent disc. The disc, as shown, may be concave on its outer surface, to be recessed within the outer extremity of the cap rim 19.

From the foregoing it will be understood that an improved grip and cap assembly is provided for the shaft of the golf club which is both aesthetically and structurally advantageous, and the cap is firmly retained in place.

During assembly, the grip tube is first applied to the shaft, with suitably applied solvent or cement therebetween. Then, under heat and pressure, the cap is applied to the grip, so that a bond is effected therebetween, and the grip material forms a mechanical connection within the cavity of the cap. When suitable lapse of time permits the solvent or adhesive to evaporate or set, by ventilation through the cap opening 15, then the disc can be snapped in place with the indicia thereon or after installation of a separate indicia bearing wafer, and the disc is securely retained in place by the overhanging rim.

The oppositely facing shoulders of the disc, within the flange 12 and the rim 19 also enable the cap to be molded in a separable mold. The shoulder in the flange 12 will retain the cap in one mold part, when the other mold part is pulled from the rim 19, and then the cap can be pulled from said one mold part.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. For assembly to the shaft of a golf club, utilizing solvent or cement requiring evaporation for setting, a combination comprising, a generally tubular grip of plastic material adapted to be sleeved over the shaft and secured thereto by the solvent or cement, a cap having, an annular flange concentric with and abutting one end of said grip, an opening extending entirely through said flange placing the interior of the grip in communication with atmosphere to permit evaporation of the solvent or cement, an annular inner rim integral with said flange extending axially toward and about said one end of said grip fixedly secured thereto, an annular outer rim integral with said flange extending thereabout on the opposite side of said flange from said inner rim;

a disk bearing selected indicia, seatable on said flange on the opposite side thereof from said grip; and locking means on said outer rim, enabling insertion of said disk within said outer rim, for locking said disk in seated position on said flange closing said opening.

2. The combination defined in claim 1, wherein said cap is of resilient material and wherein said locking means includes a peripheral groove bevelled inwardly towards said flange and so dimensioned that said outer rim can be resiliently deformed to enable said disk to enter said groove and be locked therein.

* * * * *